US007262586B1

(12) United States Patent
Gradinariu

(10) Patent No.: US 7,262,586 B1
(45) Date of Patent: Aug. 28, 2007

(54) SHUNT TYPE VOLTAGE REGULATOR

(75) Inventor: Iulian Gradinariu, Colorado Springs, CO (US)

(73) Assignee: Cypress Semiconductor Corporation, San Jose, CA (US)

( * ) Notice: Subject to any disclaimer, the term of this patent is extended or adjusted under 35 U.S.C. 154(b) by 122 days.

(21) Appl. No.: 11/095,909

(22) Filed: Mar. 31, 2005

(51) Int. Cl.
*G05F 1/40* (2006.01)
*G05F 3/16* (2006.01)

(52) U.S. Cl. ..... 323/280; 323/316

(58) Field of Classification Search ..... 323/313, 323/314, 315, 316, 269, 270, 274, 275, 280, 323/281

See application file for complete search history.

(56) References Cited

U.S. PATENT DOCUMENTS 4,851,759 A 7/1989 Blauschild
4,884,161 A 11/1989 Atherton et al.
4,893,030 A 1/1990 Shearer et al.
5,637,992 A 6/1997 Edwards
6,081,440 A 6/2000 Washburn et al.
6,108,227 A 8/2000 Voelkel
6,157,176 A 12/2000 Pulvirenti et al.
6,222,353 B1 4/2001 Pattamatta et al.
6,232,757 B1 5/2001 Afgahi et al.
6,240,000 B1 5/2001 Sywyk et al.
6,253,280 B1 6/2001 Voelkel
6,268,262 B1 7/2001 Washburn et al.
6,373,231 B1 4/2002 Lacey et al.
6,480,406 B1 11/2002 Jin et al.
6,502,163 B1 12/2002 Ramankutty
6,504,740 B1 1/2003 Voelkel
6,505,270 B1 1/2003 Voelkel et al.
6,515,884 B1 2/2003 Sywyk et al.
6,522,111 B2 2/2003 Zadeh et al.
6,566,851 B1 * 5/2003 Schuelke et al. ..... 323/315
6,586,917 B1 * 7/2003 Smith ..... 323/280
6,647,457 B1 11/2003 Sywyk et al.
6,661,716 B1 12/2003 Sywyk
6,697,275 B1 2/2004 Sywyk et al.
6,721,202 B1 4/2004 Roge et al.
6,751,755 B1 6/2004 Sywyk et al.
6,763,426 B1 7/2004 James et al.
6,772,279 B1 8/2004 Sun et al.
6,804,744 B1 10/2004 Abbas
6,845,024 B1 1/2005 Wanzakhade et al.
6,876,558 B1 4/2005 James et al.
6,879,142 B2 4/2005 Chen
6,892,273 B1 5/2005 James et al.
7,026,802 B2 * 4/2006 Gradinariu ..... 323/316

OTHER PUBLICATIONS

U.S. Appl. No. 10/271,660, David James.
U.S. Appl. No. 10/320,049, David James.

(Continued)

*Primary Examiner*—Jessica Han
(74) *Attorney, Agent, or Firm*—Haverstock & Owens LLP

(57) ABSTRACT

A shunt type voltage regulator circuit (300) can include a load supply circuit (306) and feedback circuit (308-0) that provide impedance modulated according to a first feedback circuit (308), thus limiting power consumption at higher power supply ranges. In addition, a faster regulation response can be provided by a current conveyor circuit (312') that can force the voltage at a regulated load node (304) to match that at a replication node (316).

20 Claims, 4 Drawing Sheets

OTHER PUBLICATIONS

U.S. Appl. No. 10/285,198, David James.
U.S. Appl. No. 10/286,199, Jagad Rajamanickam.
U.S. Appl. No. 10/281,814, David James.
U.S. Appl. No. 10/264,667, David James.
U.S. Appl. No. 10/264,668, Jagad Rajamanickam.
U.S. Appl. No. 10/329,146, David James.
U.S. Appl. No. 10/266,953, Sankjay Wanzakhade.
U.S. Appl. No. 10/320,588, Sanjay Wanzakhade.
U.S. Appl. No. 10/320,053, Sanjay Wanzakhade.
U.S. Appl. No. 10/202,526, Janet Zou.
U.S. Appl. No. 10/873,608, Anita X. Meng.
U.S. Appl. No. 10/748,899, Hart Om.
U.S. Appl. No. 11/000,568, Scott Smith.
U.S. Appl. No. 11/011,464, Scott Smith.
U.S. Appl. No. 10/897,082, Venkatachary.
U.S. Appl. No. 10/940,129, Steven Narum.
U.S. Appl. No. 10/950,323, Mark Birman.
U.S. Appl. No. 10/977,516, Hart Om.
U.S. Appl. No. 11/014,123, Hart Om.
U.S. Appl. No. 11/043,391, Pankaj Gupta.
U.S. Appl. No. 60/612,905, Venkatachary.
U.S. Appl. No. 60/663,656, Dinesh Maheshwari.
U.S. Appl. No. 60/661,745, Dinesh Maheshwari.
U.S. Appl. No. 60/657,754, Dinesh Maheshwari.
U.S. Appl. No. 60/629,694, Bin Jiang.
U.S. Appl. No. 60/666,875, Dinesh Maheshwari.
U.S. Appl. No. 11/085,399, Hart Om.
U.S. Appl. No. 11/089,837, Scott Smith.
U.S. Appl. No. 60/667,325, Hart Om.
U.S. Appl. No. 10/247,746, Richard Chou.
U.S. Appl. No. 11/090,116, Bartosz Banachowicz.

* cited by examiner

SHUNT TYPE VOLTAGE REGULATOR

TECHNICAL FIELD

The present invention relates generally to voltage regulator circuits, and more particularly to shunt type voltage regulator circuits.

BACKGROUND OF THE INVENTION

Voltage regulator circuits can serve numerous purposes in integrated circuit devices. One particular application can be to regulate an internal power supply voltage for certain sections of an integrated circuit device. Even more particularly, voltage regulators can supply a power supply voltage to memory cell arrays within memory devices, such as content addressable memories (CAMs), static random access memories (SRAMs) and dynamic RAMs (DRAMs), as but a few of the many possible applications.

Among the various types of voltage regulators are "shunt" type regulators. A typical shunt regulator provides a shunting current path from a load (i.e., the regulated node). When a voltage to the load exceeds a predetermined amount, the shunt path can be enabled, and typically, a large amount of current is diverted (shunted) from the load to prevent an overvoltage condition at the load.

One conventional shunt regulator is shown in U.S. Pat. No. 6,586,917 B1 issued to Gregory J. Smith on Jul. 1, 2003 (Smith). Smith teaches an arrangement in which a shunting device can be enabled in response to either of two feedback loops. The feedback loops both include fixed resistors that provide a voltage divider that provides an input voltage to an amplifier. When a voltage divider potential exceeds a given reference voltage, the amplifier enables the shunt device, which shunts current to ground until the feedback loop(s) indicates a regulator input or output has returned to a desired level.

While arrangements like that of Smith can provide appropriate current shunting for certain applications, such arrangements can be less suitable for other applications. In particular, in some applications it may be desirable to limit power consumption and/or current draw as much as possible. In approaches like Smith, there can be considerable power consumption at the high limit of an external power supply range, as each time the power supply voltage exceeds the regulation limit, by even a relatively small amount, the amplifier can drive the shunting device (e.g., transistor) into saturation, and large amounts of current can be shunted to ground. In addition, such periodic current draws can tax power supply current sourcing capabilities, which may already be strained in high current applications, such as CAM devices, as but one example.

In addition, approaches like that of Smith may provide insufficient response at higher frequencies (greater than 1 MHz). If a load capacitance is relatively low with respect to peak load current demands, a regulated node potential may jump well beyond a desired limit before current shunting brings the potential back to the desired level.

A voltage regulator utilizing a current conveyor is shown in U.S. patent application Ser. No. 10/965,445, filed on Oct. 14, 2004, and corresponding International Application PCT/US2004/043756, filed on Dec. 22, 2004, entitled REPLICA BIASED VOLTAGE REGULATOR by the present inventor Iulian Gradinariu.

In light of the above, it would be desirable to arrive at a shunt-type voltage regulator that does not suffer from the above drawbacks of conventional approaches. More particularly, it would be desirable to provide a shunt-type voltage regulator that can provide a regulated voltage at higher supply ranges without consuming relatively large amounts of current. Further, it would be desirable for such a voltage regulator to provide a better high frequency response than conventional arrangements like those described above.

SUMMARY OF THE INVENTION

A voltage regulator circuit can include a first feedback circuit with a modulated feedback impedance. Such a first feedback circuit can include a first amplifier with a first input coupled to a reference node, a second input coupled to a load replication node, and an output. In addition, a modulated impedance feedback circuit can be coupled between the load replication node and a power supply node. The modulated impedance feedback circuit can include a feedback resistor and transistor connected in parallel between the power supply node and the load replication node. A control terminal of the feedback transistor can be coupled to the output of the first amplifier. Such an arrangement can generate a potential at the load replication node without having to draw large amounts of current at the upper limits of a power supply voltage.

According to one aspect of the embodiments, a power supply node can be a high power supply node and the feedback transistor comprises a p-channel insulated gate field effect transistor. The feedback transistor can operate in the linear range, and thus modulate the effective impedance of the feedback circuit as regulation occurs.

According to another aspect of the embodiments, a voltage regulator circuit can further include a modulated impedance load supply circuit coupled between a load node and the power supply node. The modulated impedance load supply circuit can include a load supply resistor and transistor coupled in parallel between the power supply node and the load node. A control terminal of the load supply transistor can be coupled to the output of the first amplifier. A resistance ratio between the feedback resistor and load supply resistor can be about 1:n and a width/length ratio between the feedback transistor and the load supply transistor can be about 1:n, where n>1.

In such an arrangement, the impedance path providing current to a load node can be modulated in the same fashion as the feedback impedance. Thus, a load supply transistor can operate in the linear range, and thus provide power savings at higher power supply limits as large amounts of current need not be shunted from the load, as can occur in the above conventional case.

According to another aspect of the embodiments, a voltage regulator circuit can further include a replication response circuit coupled to the replication node. A replication response circuit can include a reference resistor in parallel with a response capacitor. A response circuit can serve to prevent voltage at a replication node from varying at rates beyond a predetermined bandwidth limit of the first feedback circuit. In this way, a first feedback circuit can provide regulation over a certain frequency range, while a response circuit can provide regulation over another frequency range.

According to another aspect of the embodiments, a voltage regulator circuit can further include a shunt transistor having source-drain path coupled to a load node and a current conveyor circuit. A current conveyor circuit can include a first conveyor transistor having a source-drain path coupled to the replication node, and a second conveyor transistor having a source-drain path coupled to the load node. Such conveyor transistors can be cross-coupled with respect to one another. In addition, a drain of the first conveyor transistor can be coupled to a gate of the shunt transistor. A width/length (W/L) ratio between the first and second conveyor transistors can be about 1:1, a (W/L) ratio between the second conveyor transistor and the shunt transistor can be about 1:(n−1), where n>2. In such an arrangement, a current conveyor circuit can provide high frequency response to regulating a load node by operation of a current conveyor circuit, which can force the load node to match the replication node.

According to another aspect of the embodiments, a voltage regulator circuit can further include a bias control circuit with a current mirror coupled to the replication node and a second amplifier having a first input coupled to the reference node, a second input coupled to one leg of the current mirror, and an output coupled to the gates of the first and second biasing transistors. First and second biasing transistors can have source-drain paths in series with the first and second conveyor transistors. Such a biasing circuit can establish the operating point of the current conveyor circuit over variations in operating voltage and/or manufacturing process and/or temperature.

According to another aspect of the embodiments, a bias circuit can include a current mirror comprising cross coupled first and second bias control transistors having sources coupled to the replication node, a third bias control transistor having a source coupled to a drain of the second bias control transistor and a gate coupled to the output of the bias feedback amplifier, and a resistor coupled to a drain of the first bias control transistor.

The present invention can also include a method of shunt regulating a voltage. The method can include modulating a load supply impedance between a power supply node and a regulated load node with a load supply transistor in the linear region, according to a potential at a replication node. The method can also include modulating a feedback impedance between the power supply node and the replication node with a feedback transistor in the linear region of operation, also according to the potential at the replication node. Such an arrangement can provide low current, lower speed regulation response. The method further includes mirroring the voltage levels between the regulated load node and the replication node, which can provide a high-speed regulation response.

According to another aspect of the embodiments, the method can include comparing a voltage at the replication node and the reference voltage with feedback path having a unity-gain limit frequency. In addition, the method can include suppressing variations in the voltage at the replication node outside of a unity-gain frequency of the feedback path with at least one response circuit.

DETAILED DESCRIPTION

Various embodiments of the present invention will now be described in detail with reference to a number of drawings. The embodiments describe a shunt-type voltage regulator that can provide shunt type regulation without consuming large amounts of current at the higher end of a power supply range. In addition, such a voltage regulator can provide a regulating response for a wide frequency range with respect to conventional approaches like those described above.

Figure 1:
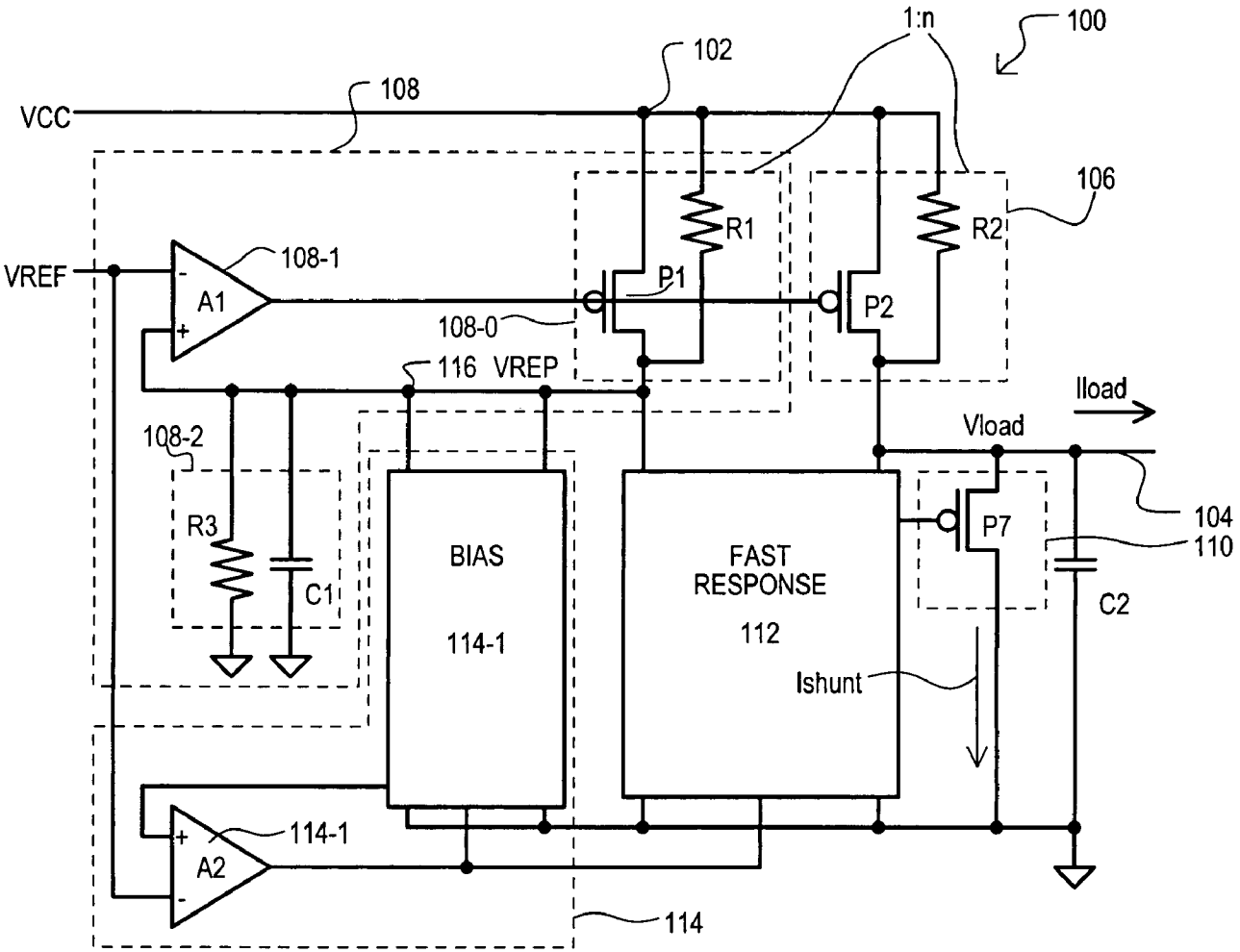
FIG. 1 is a schematic diagram of a voltage regulator circuit according to a first embodiment.

A shunt-type voltage regulator according to a first embodiment is set forth in FIG. 1 and designated by the general reference character 100. A voltage regulator 100 can receive a power supply voltage (VCC) at a first supply node 102 and provide a regulated voltage (Vload) at a regulated node 104. A load capacitance is represented in FIG. 1 by capacitor C2.

In the example of FIG. 1, a voltage regulator 100 can include a load supply circuit 106, a first feedback circuit 108, a shunt circuit 110, a fast response circuit 112, and a bias feedback circuit 114.

A load supply circuit 106 can provide current from a first power supply node 102 to a regulated node 104. However, unlike conventional arrangements like that described above, such a circuit can provide a modulated impedance by including not only a resistor, but also an active device that can provide a controllable impedance path in parallel with such a resistor. In the particular arrangement of FIG. 1, a modulated impedance circuit 106 can include a p-channel insulated gate field effect transistor (IGFET) P2 with a source-drain path in parallel with a resistor R2. As will be described in more detail below, in operation, transistor P2 can be biased to operate in the linear range. In such an arrangement, an essentially constant current can be drawn through all higher ranges of a power supply voltage, thus preventing high power consumption as can occur in conventional cases, when current is suddenly shunted through a transistor biased to saturation.

A modulated impedance load supply circuit 106 can be controlled by a first feedback circuit 108. A first feedback circuit 108 can include a modulated feedback circuit 108-0, a first amplifier 108-1, and a response circuit 108-2. A modulated feedback circuit 108-0 can provide current from first power supply node 102 to a replication node 116. As will be described in more detail below, the potential (VREP) at replication node 116 can mirror (follow in a very fast fashion) the potential (Vload) at regulated node 104. A modulated feedback circuit 108-0 can be connected between a first power supply node 102 and a replication node 116, and can have the same general structure as load supply circuit 106, but be scaled with respect thereto. Preferably, resistors/transistors of each such circuit can be ratioed in the same essential way. That is, in one preferable arrangement, $R1/R2=W/L_{P1}/WL_{P2}=1/n$, where R1 is the resistance of resistor R1, R2 is the resistance of resistor R2, $W/L_{P1}$ is a width/length ratio of transistor P1, and $W/L_{P2}$ is a width/length ratio of transistor P2, and n is greater than 1.

A first amplifier 108-1 can be an operational type amplifier having an inverting input that receives a reference voltage VREF, and a non-inverting input coupled to the replication node 116, and an output that drives transistors P1 and P2 of modulated feedback circuit 108-0 and load supply circuit 106, respectively. In this way, first amplifier 108-1 can provide negative feedback that seeks to force replication node 116 to a constant potential based on reference voltage VREF, by modulating the impedance of linearly biased transistor P1. At the same time, larger current supply transistor P2 can be driven in the same fashion. It is understood that in such an arrangement, both modulated feedback circuit 108-0 and load supply circuit 106 will not suddenly source large amounts of current to the load, as a power supply voltage VCC varies near the high end. Rather, linearly biased transistors P1 and P2 can continue to operate in the linear region, and hence draw essentially the same amount of current from the supply node.

Response circuit 108-2 can include resistor R3 in parallel with capacitor C1. Resistor R3 in combination with modulated feedback circuit 108-0 can provide a current path for feedback circuit 108 to generate a potential at replication node 116. Capacitor C1 can serve to maintain replication node 116 at a constant voltage VREP. More particularly, the negative feedback loop provided by first amplifier 108-1 can have limited unity gain bandwidth. A capacitor C1 can be selected to maintain replication node 116 at the VREP level when beyond the unity gain bandwidth of the feedback loop.

In this way, a voltage regulator 100 can have a first feedback circuit 108 that can maintain a regulated level when a power supply voltage rises beyond a desired limit without the shunting of relatively large amounts of current, as can occur in conventional arrangements like those described above.

A fast response circuit 112 can force a potential VREP at replication node 116 to essentially mirror a load voltage Vload at regulated node 104. Further, a voltage driving such mirroring devices can drive shunt circuit 110. Such a fast response circuit 112 can operate to provide a regulating force at a higher frequency than a first feedback circuit 108. More detailed fast response circuits will be described in other embodiments below.

In such an arrangement, a first feedback circuit 108 can provide a lower frequency regulation, while higher frequency response can be provided by a fast response circuit 112.

A bias feedback circuit 114 can control the operating parameters of a fast response circuit 112. In particular, a bias feedback circuit 114 can control the operating point of a fast response circuit 112 based on a potential at replication node 116. A second amplifier 114-0 can be an operational type amplifier having an inverting input that receives a reference voltage VREF, and a non-inverting input coupled to a bias circuit 114-1. According to such a comparison, second amplifier 114-0 can provide an operating bias voltage to bias circuit 114-1 and fast response circuit 112.

A shunt-type voltage regulator according to a second embodiment will now be described with reference to FIG. 2, and is designated by the general reference character 200. A voltage regulator 200 can include some of the same general sections as the first embodiment. Accordingly, like sections will be referred to by the same reference character but with the first digit being a "2" instead of a "1".

Thus, voltage regulator 200 can include a load supply circuit 206 composed of a resistor R2' in parallel with an active device T2, as well as a modulated feedback circuit 208-0 composed of resistor R1' in parallel with an active device T1.

Figure 2:
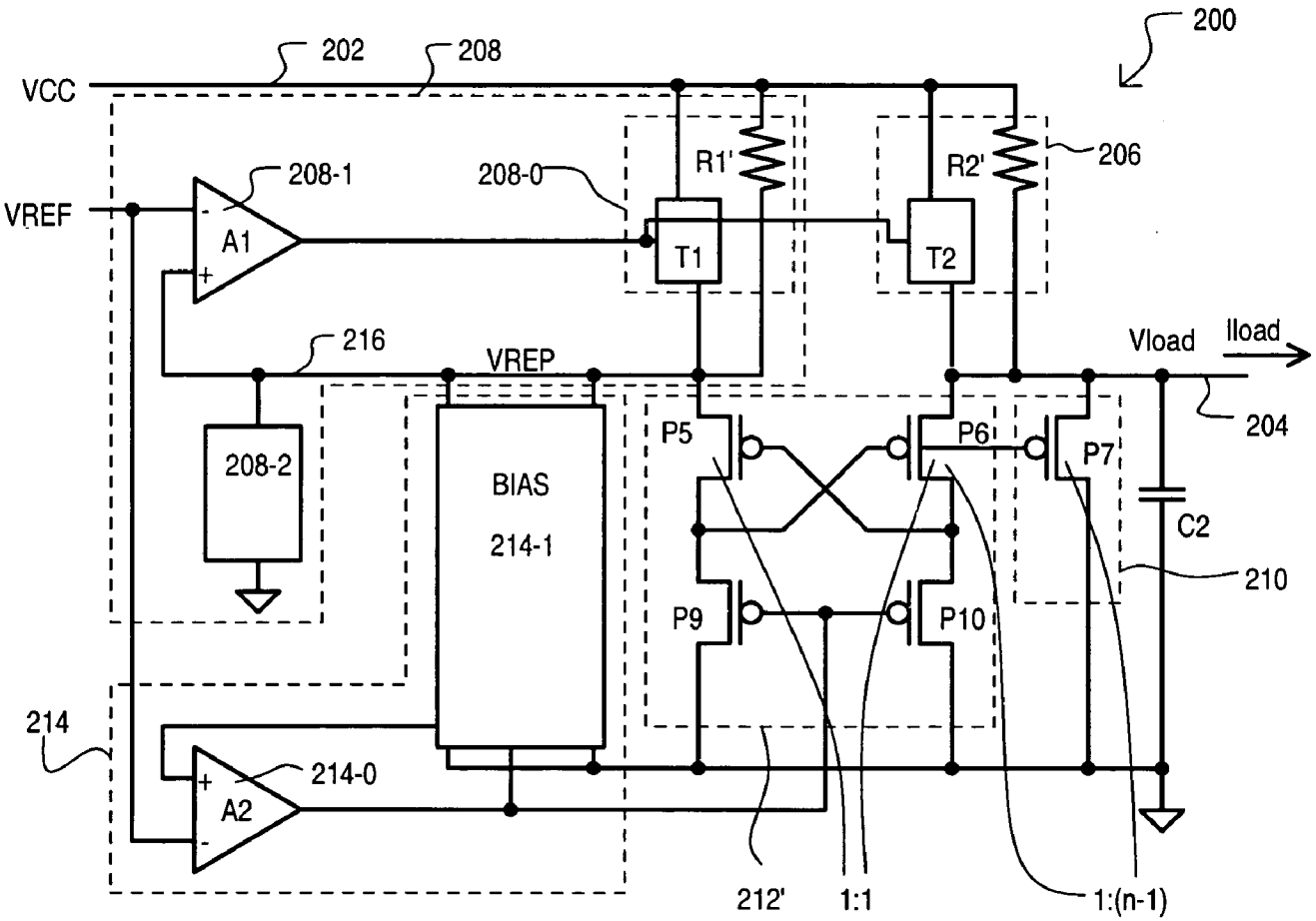
FIG. 2 is a schematic diagram of a voltage regulator circuit according to a second embodiment.

The embodiment of FIG. 2 differs from that of FIG. 1 in that it provides a more detailed example of a fast response circuit. In particular, a fast response circuit can be a current conveyor circuit 212' that forces the potential at replication node 216 to follow that of regulated node 204. More particularly, a current conveyor 212' can include two circuit legs, each of which can draw current. Such circuit legs can be arranged as "voltage mirrors", with the replica voltage (VREP) at replica node 216 being forced to track the regulated node 204 voltage (Vload), and vice versa.

In the very particular example of FIG. 2, a current conveyor 212' can include p-channel transistors P5 and P6 having a cross-coupled configuration, with transistor P5 can having a gate connected to a drain of transistor P6, while transistor P6 has gate connected to a drain of transistor P5. In addition, another p-channel transistor P9 can have a source-drain path arranged in series with that of transistor P5 to form a replica leg, while another transistor P10 have a source-drain path arranged in series with that of transistor P6 to form an output leg. In such an arrangement, a replica voltage (VREP) can be provided at the source of transistor P6 and the output voltage (Vload) can be provided at the source of transistor P5.

In the very particular example of FIG. 2, Transistors (P5, P6, P9, P10) of current conveyor 212' can preferably be matched devices, having the same properties (e.g., threshold voltage) and same size. Such an arrangement provides for quasi-instantaneous "positive feedback" response that can force VREP=Vload.

As also shown in FIG. 2, a drain of transistor P5 within the replica leg can also drive shunt circuit 210. Further, shunt circuit 210 can include a p-channel transistor P7 that is scaled with respect to the cross-coupled transistors P5 and P6 to provide greater current sinking capabilities than an output leg of current conveyor 212'. In particular, $W/L_{P5}=WL_{P6}$, $W/L_{P5}$ or $_{P6}/WL_{P7}=1/(n-1)$ where $W/L_{P5}$, $W/L_{P6}$, $W/L_{P7}$, are width/length ratios of transistors P5, P6 and P7, respectively, and n is greater than 2. Even more particularly, transistors P5, P6 and P7 can have the above relationship, and p-channel devices within a modulated feedback circuit 208-0 and load supply circuit 206 can be sized as in FIG. 1, i.e., $W/L_{P2}/WL_{P2}=1/n$.

In this way, a voltage regulator 200 can provide a fast positive feedback response that activates a shunting circuit in order regulate a circuit node.

A shunt-type voltage regulator according to a third embodiment will now be described with reference to FIG. 3, and is designated by the general reference character 300. A voltage regulator 300 can include some of the same general sections as the first embodiment. Accordingly, like sections will be referred to by the same reference character but with the first digit being a "3" instead of a "1".

Figure 3:
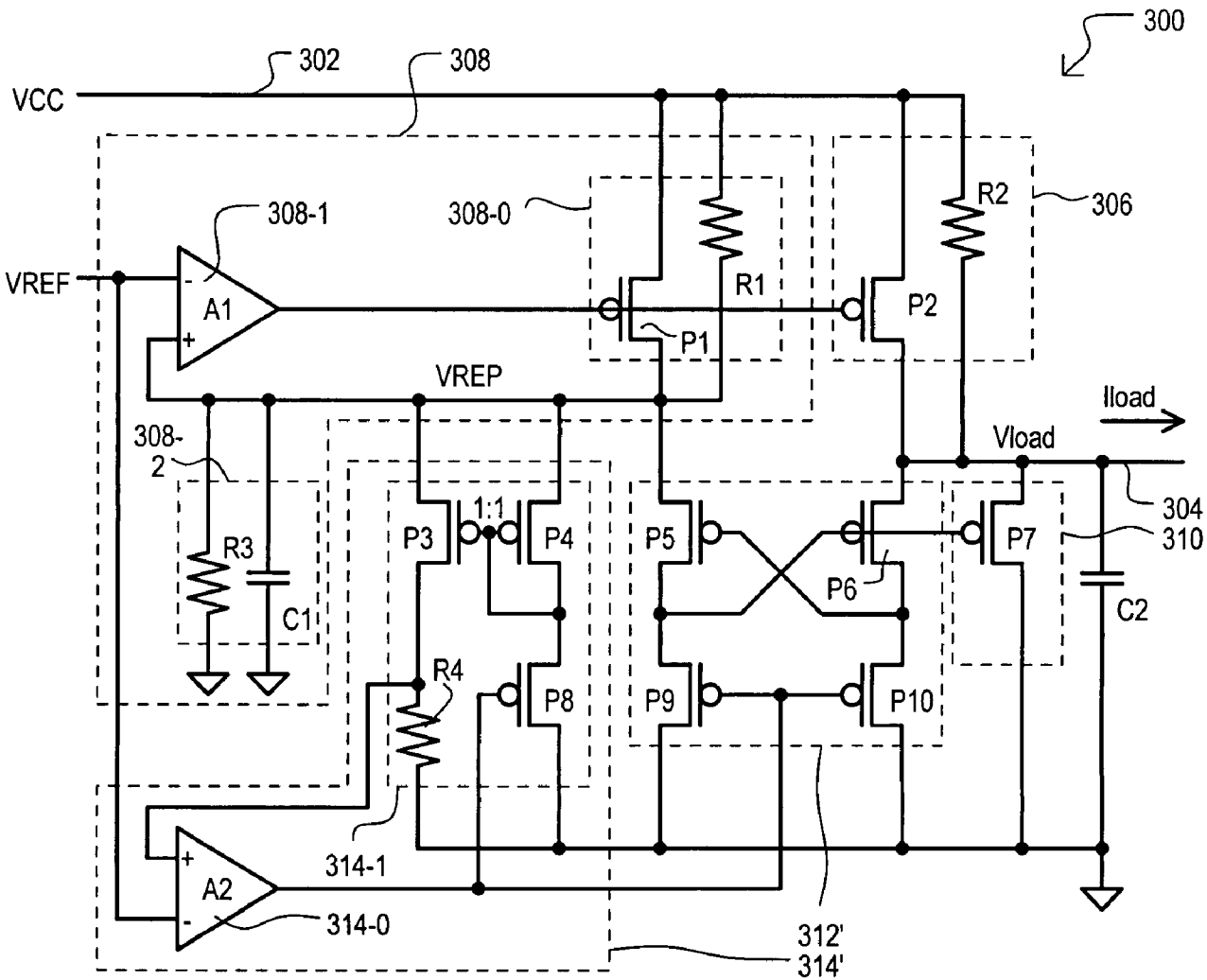
FIG. 3 is a schematic diagram of a voltage regulator circuit according to a third embodiment.

In the particular example of FIG. 3, voltage regulator 300 can include a load supply circuit 306, first feedback circuit 308, and shunt circuit 310 like those of the first embodiment 100 shown in FIG. 1. In addition, voltage regulator 300 can include a fast response circuit 312' like that of the second embodiment 200 shown in FIG. 2 (i.e., a current conveyor circuit).

The embodiment of FIG. 3 can differ from that of FIGS. 1 and 2 in that it shows a more detailed example of a bias feedback circuit 314'. In particular, a bias feedback circuit 314' can include a second amplifier 314-0 and a bias circuit 314-1 having current mirror formed from p-channel transistors P3 and P4, as well as a resistor R4, and bias transistor P8. In such an arrangement, bias feedback circuit 314' and second amplifier 314-0 can form a feedback loop that provides a bias voltage to current conveyor circuit 312' that can maintain the operating current of the current conveyor circuit 312' essentially constant over variations in process and/or voltage and/or temperature.

The above embodiments can provide advantageously lower power consumption and fast response to changes in a power supply voltage over conventional approaches like those described above. As but one example, the embodiment of FIG. 3 can be employed as a step down voltage regulator that provides a 1.25 volt regulated voltage (Vload) based on a 1.5 volt supply voltage (VCC). In such an arrangement, the regulator circuit can provide 2.5 amperes (A) average current and up to 7.5 A peak current into an 80 nF load. Such capabilities can be provided without the shunting of large amounts of current at the higher end of the supply ranges, providing advantageously less power consumption than conventional shunting approaches. Further, in such an application a minimum cycle time can be about 8 ns while a peak current time can be about 3 ns.

While a voltage regulator according to the above embodiments may regulate various types of circuits, due to the power saving and fast peak current response, such voltage regulators may be particularly advantageous for regulating content addressable memory (CAM) cell arrays. One particular embodiment of such a voltage regulating circuit is shown in FIG. 4.

Figure 4:
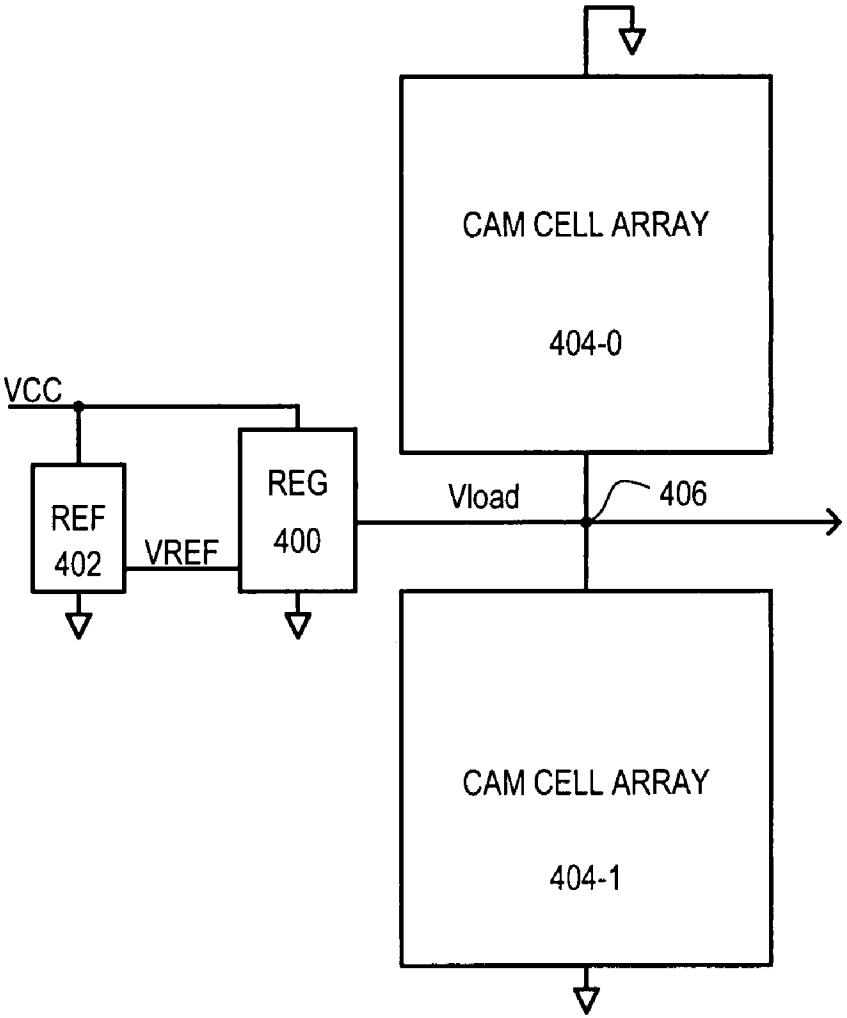
FIG. 4 is a schematic diagram of a voltage regulator according to a fourth embodiment.

FIG. 4 shows a CAM voltage regulator that can include a voltage regulator circuit 400, a reference voltage circuit 402, and a number of CAM cell arrays 404-0 and 404-1. A voltage regulator circuit 400 can be any of the shunt type voltage regulator circuits described in the above embodiments, and can regulate an internal step-down power supply node 406 used by one or more CAM cell arrays. A voltage regulator circuit 400 can receive a power supply voltage VCC as well as a reference voltage VREF form voltage circuit 402.

A reference voltage circuit 402 can generate a reference voltage according to well understood techniques, including but not limited to bandgap and related type approaches.

CAM arrays (404-0 and 404-1) can benefit from the fast response provided by a current conveyor controlled node regulations, as shown above, as such arrays can suddenly draw large amounts of current in search operations. Further, overall power consumption can be reduced over conventional arrangements that do not provide modulated impedances, as in the above embodiments.

It is also understood that the embodiments of the invention may be practiced in the absence of an element and or step not specifically disclosed. That is, an inventive feature of the invention can be elimination of an element.

Accordingly, while the various aspects of the particular embodiments set forth herein have been described in detail, the present invention could be subject to various changes, substitutions, and alterations without departing from the spirit and scope of the invention.

What is claimed is:

1. A voltage regulator circuit, comprising:

a first feedback circuit that includes a first amplifier having a first input coupled to a reference node, a second input coupled to a load replication node, and an output, and a modulated impedance feedback circuit coupled between the load replication node and a power supply node, the modulated impedance feedback circuit including a feedback resistor coupled between the power supply node and the load replication node, and a feedback transistor having a controllable impedance path coupled between the power supply node and the load replication node, and a control terminal coupled to the output of the first amplifier.

2. The voltage regulator circuit of claim 1, wherein:

the power supply node is a high power supply node; and the feedback transistor comprises a p-channel insulated gate field effect transistor.

3. The voltage regulator circuit of claim 1, further including:

a modulated impedance load supply circuit coupled between a load node and the power supply node, the modulated impedance load supply circuit including a load supply resistor coupled between the power supply node and the load node, and a load supply transistor having a controllable impedance path coupled between the power supply node and the load node, and a control terminal coupled to the output of the first amplifier; wherein a resistance ratio between the feedback resistor and load supply resistor is about 1:n and a width/length ratio between the feedback transistor and the load supply transistor is about 1:n, where n>1.

4. The voltage regulator circuit of claim 1, further including:

a response circuit coupled to the replication node comprising a reference resistor in parallel with a response capacitor.

5. The voltage regulator circuit of claim 1, further including:

a shunt transistor having source-drain path coupled to a load node; and a current conveyor circuit comprising a first conveyor transistor having a source-drain path coupled to the replication node, and a second conveyor transistor having a source-drain path coupled to the load node, a drain coupled to a gate of the first conveyor transistor and a gate coupled to a drain of the first conveyor transistor and the gate of the shunt transistor; wherein a width/length (W/L) ratio between the first and second conveyor transistors is about 1:1, and a (W/L) ratio between the second conveyor transistor and the shunt transistor is about 1:(n−1), where n>2.

6. The voltage regulator circuit of claim 5, wherein:

the first conveyor transistor, second conveyor transistor, and shunt transistor are p-channel insulated gate field effect transistors.

7. The voltage regulator circuit of claim 5, further including:

the current conveyor circuit further includes a first biasing transistor having a source-drain path in series with the first conveyor transistor, and a second biasing transistor having a source-drain path in series with the second conveyor transistor, and a gate connected to a gate of the first biasing transistor.

8. The voltage regulator circuit of claim 7, further including:

a bias control circuit, comprising a current mirror coupled to the replication node, a second amplifier having a first input coupled to the reference node, a second input coupled to one leg of the current mirror, and an output coupled to the gates of the first and second biasing transistors.

9. A voltage regulator circuit, comprising:

a modulated impedance load supply circuit, coupled between a power supply node and a load node, comprising a load supply resistor in parallel with a load supply transistor; and a shunt transistor having a source-drain path coupled to the load node; and a current conveyor circuit comprising cross coupled first and second conveyor transistors, a source of the first conveyor transistor being coupled to a replication node, and a source of the second conveyor transistor being coupled to the load node and the gate of the second conveyor transistor coupled to the shunt transistor.

10. The voltage regulator circuit of claim 9, wherein:

a width/length (W/L) ratio between the first and second conveyor transistors is about 1:1 and the W/L ratio between the second conveyor transistor and the shunt transistor is about 1:(n−1), where n>2.

11. The voltage regulator circuit of claim 9, wherein:

the current conveyor circuit further includes a first biasing transistor having a source-drain path coupled to a drain of the first conveyor transistor and a second biasing transistor having a source-drain path coupled to a drain of the second conveyor transistor and a gate coupled to the gate of the first biasing transistor; and a bias control circuit including a bias feedback amplifier having a first input coupled to a reference node and an output coupled to the gates of the first and second biasing transistors.

12. The voltage regulator circuit of claim 11, further including:

the bias control circuit further includes a current mirror comprising cross coupled first and second bias control transistors having sources coupled to the replication node, a third bias control transistor having a source coupled to a drain of the second bias control transistor and a gate coupled to the output of the bias feedback amplifier, a bias resistor coupled to a drain of the first bias control transistor, and the bias feedback amplifier has a second input coupled to the drain of the first bias control transistor.

13. The voltage regulator circuit of claim 9, further including:

a modulated impedance feedback circuit coupled between the power supply node and the load replication node comprising a feedback resistor in parallel with a feedback transistor.

14. The voltage regulator circuit of claim 13, wherein:

a feedback amplifier having a first input coupled to a reference node, a second input coupled to the replication node, and an output coupled to the gates of the feedback transistor and load supply transistor.

15. A method of regulating a voltage, comprising:

modulating a load supply impedance between a power supply node and a regulated load node with a load supply transistor in the linear region according to a potential at a replication node;

modulating a feedback impedance between the power supply node and the replication node with a feedback transistor in the linear region of operation according to the potential at the replication node; and mirroring the impedance between the regulated load node and the replication node.

16. The method of claim 15, wherein:

modulating the load supply impedance and feedback impedance includes varying the load supply impedance and feedback impedance according to a comparison between a voltage at the replication node and a reference voltage.

17. The method of claim 16, further including:

the comparison between the voltage at the replication node and the reference voltage has a unity-gain limit frequency; and suppressing variations in the voltage at the replication node with at least one capacitor for variations in a potential at the power supply node that are outside the unity-gain frequency.

18. The method of claim 15, wherein:

mirroring the potentials between the regulated load node and the replication node includes providing cross-coupled first and second conveyor transistors between the replication node and the load node, with a source of a first conveyor transistor connected to the replication node and a source of the second conveyor transistor connected to the regulated load node.

19. The method of claim 15, further including:

providing a load shunt path that shunts current away from the load, and modulating the impedance of the load shunt path based on the voltage mirrored in the replication node.

20. The method of claim 19, wherein:

providing the load shunt path includes providing a p-channel shunt insulated gate field effect transistor (IGFET) having a source coupled to the regulated load node; and modulating the impedance of the load shunt path includes mirroring the potentials between the regulated load node and the replication node includes providing cross-coupled first and second conveyor transistors between the replication node and the load node, with a source of a first conveyor transistor connected to the replication node and a source of the second conveyor transistor connected to the regulated load node, and coupling a gate of the shunt P-channel IGFET to the drain of the first conveyor transistor.

* * * * *